US005821964A

United States Patent [19]

Bidwell

[11] Patent Number: 5,821,964

[45] Date of Patent: Oct. 13, 1998

[54] CARTRIDGE FOR SUPPLYING LIQUID TO A PRINT HEAD

[75] Inventor: Norman Bidwell, Marietta, Ga.

[73] Assignee: Dataproducts Corporation, Simi Valley, Calif.

[21] Appl. No.: 686,308

[22] Filed: Jul. 24, 1996

[51] Int. Cl.[6] ..... B41J 2/175

[52] U.S. Cl. ..... 347/86

[58] Field of Search ..... 347/86, 87, 84, 347/85

[56] References Cited

U.S. PATENT DOCUMENTS

| | | | |
|---|---|---|---|
| 4,771,295 | 9/1988 | Baker et al. | 347/87 |
| 5,262,802 | 11/1993 | Karita et al. | 347/87 |
| 5,509,140 | 4/1996 | Koitabashi et al. | 347/87 |

FOREIGN PATENT DOCUMENTS

| | | |
|---|---|---|
| 0493058 | 12/1991 | European Pat. Off. . |
| 0581531 | 7/1993 | European Pat. Off. . |
| 0631874 | 6/1994 | European Pat. Off. . |
| 0711667 | 11/1994 | European Pat. Off. . |
| 0691207 | 7/1995 | European Pat. Off. . |
| 0703083 | 9/1995 | European Pat. Off. . |
| 0709211 | 9/1995 | European Pat. Off. . |
| 676 294 A2 | 10/1995 | European Pat. Off. ..... 347/87 |

*Primary Examiner*—Benjamin R. Fuller
*Assistant Examiner*—Judy Nguyen
*Attorney, Agent, or Firm*—Pillsbury Madison & Sutro LLP

[57] ABSTRACT

A cartridge of the type used with a printer is provided for supplying liquid to the printer. The cartridge includes a container that has first through sixth walls and a partition in the form of an inner wall that substantially divides the container into first and second compartments. The partition extends from the third wall to near the fourth wall to form a communication gap between the partition and the fourth wall. The container also has a first opening in the first compartment for allowing air to enter, and a second opening in the first compartment for interfacing with the printer's print head. A stranded material is disposed in the first compartment so that it extends along the first partition to a location between the end of the first partition and the fourth wall. A foam material is disposed in and substantially fills the remainder of the first compartment. The stranded material functions to regulate the internal pressure of the cartridge by selectively providing a low resistance path for air to pass from the first compartment, through the stranded material and the gap, and into the second compartment. This allows the cartridge to supply ink to the print head while keeping the pressure in the cartridge, and thus the vacuum in the print head, substantially constant.

10 Claims, 8 Drawing Sheets

CARTRIDGE FOR SUPPLYING LIQUID TO A PRINT HEAD

FIELD OF THE INVENTION

The present invention relates to a cartridge for containing a liquid, and more specifically to a cartridge of the type used with a printer for supplying liquid to the printer's print head.

BACKGROUND OF THE INVENTION

Ink jet printer cartridges for supplying ink to an ink jet print head are typically designed to supply ink from the cartridge to the print head without supplying air or air bubbles to the print head. It is desirable that such cartridges supply an amount of ink as required by the print head, while keeping the vacuum in the print head substantially constant. Additionally, cartridges efficiently supply ink to the print head and avoid leaking during transportation, storage, or operation.

An example of a conventional ink cartridge for an ink jet printer is disclosed in U.S. Pat. No. 5,509,140. The disclosed cartridge is formed as a container with a partitioning wall that divides the container into two compartments that can communicate only through a relatively small gap between the end of the partitioning wall and the bottom of the container. The first compartment is filled with a foam material and the second compartment is filled with ink. Additionally, the first compartment is provided with a small "air inlet" opening and a lower "ink outlet" opening for interfacing with an ink inlet port of the printer's inkjet print head. In one disclosed embodiment, at least one groove is provided on the side of the partition wall facing the first compartment. The groove functions as an air introduction passage by providing a low resistance path for air to pass from the first compartment to the second compartment via the gap. In another disclosed embodiment, the foam material in the first compartment is formed with different pore densities and the least dense portion of the foam material is disposed adjacent to the partitioning wall. Here, the least dense portion of the foam material functions as an air introduction passage because it provides the lowest resistance path for air to pass from the first compartment to the second compartment.

Initially, ink from the second compartment flows through the gap and fills a lower portion of the foam material. During operation, the ink inlet port of the inkjet print head interfaces with the foam material through the ink outlet opening in the first compartment. The print head uses suction to draw ink from the foam material into the ink inlet port of the print head. As ink is drawn from the foam material, ink from the second compartment flows through the gap and into the foam material to replace the drawn ink. As ink is removed from the second compartment, a vacuum develops in the second compartment because it is sealed except for the communication gap. Eventually, the pressure difference between the two compartments becomes so high that ink stops flowing from the second compartment to the first compartment. Unless air is introduced into the second compartment to partially relieve the vacuum, the ink in the foam material will be depleted and air will be supplied to the print head.

To prevent this, the conventional cartridge uses the less dense foam material or groove to function as an air introduction passage. Specifically, because the less dense foam material (or groove) provides less resistance to air than the denser foam material adjacent to the ink outlet, ink is purportedly first depleted from the less dense foam material (or groove) after ink stops flowing between the compartments. When ink in the less dense foam material (or groove) is depleted to below the level of the end of the partitioning wall, air can pass from the less dense foam material (or groove), through the gap, and into the second compartment. This lowers the pressure difference between the two compartments so that ink can once again flow between the two compartments to partially refill the less dense foam material (or groove). This cycle is repeated until the level of ink in the second compartment falls to below the level of the end of the partitioning wall.

Thus, in a conventional cartridge for an ink jet printer, a groove or a less dense portion of the foam material is located in the vicinity of the communication gap to function as an air introduction passage. This type of air introduction passage regulates the internal pressure of the cartridge by selectively providing a low resistance path for air to pass from the first compartment, through the air passage and the gap, and into the second compartment. This, in turn, allows the cartridge to supply the amount of ink required by the print head while keeping the vacuum in the print head substantially constant.

Furthermore, a conventional ink cartridge may suffer from sputtering (i.e., discharging ink through the air inlet opening of the cartridge). In a conventional cartridge such as described in the '140 patent, the foam material fills the portion of the first compartment adjacent to the air inlet. Typically, the cartridge will cool after use and this causes air to be taken into the cartridge. When the cartridge is later used again, the air in the cartridge warms and expands so that air is discharged through the air inlet. If the portion of the foam material adjacent to the air inlet has previously contained ink, the release of air causes some ink to also be discharged through the air inlet. Besides being messy, this sputtering can also damage the printer if the ink reaches the printer's electronic components, such as the circuit board.

SUMMARY OF THE DISCLOSURE

It is an object of preferred embodiments of the present invention to provide a cartridge with a novel type of air introduction passage for regulating the internal pressure of the cartridge. The air introduction passage of preferred embodiments of the present invention allows the cartridge to supply ink to a print head while keeping the pressure in the cartridge, and thus the vacuum in the print head, substantially constant. Another object of preferred embodiments of the present invention is to provide a cartridge with a structure that minimnizes sputtering.

According to a preferred embodiment of the present invention, a cartridge is provided for supplying liquid to a printer. The preferred embodiment is formed with a container that has first through sixth walls and a partition in the form of an inner wall. The partition functions to substantially divide the container into a first compartment and a second compartment and extends from the third wall to near the fourth wall to form a gap between the partition and the fourth wall. The gap allows communication between the first and second compartments. The container also has a first opening in the first compartment for allowing air to enter the first compartment, and a second opening in the first compartment for interfacing with the printer's print head so that liquid can be supplied from the cartridge to an inlet port of the print head. A stranded material is disposed in the first compartment so that it extends along the first partition to a location between the end of the first partition and the fourth wall. A foam material is disposed in and substantially fills the first compartment, extending at least from the stranded material to the second opening. In the preferred embodiment of the present invention, the stranded material acts to regulate the internal pressure of the cartridge by selectively providing a low resistance path for air to pass from the first compartment, through the stranded material and the gap, and into the second compartment.

In another embodiment of the present invention, the cartridge includes at least one protrusion positioned in a portion of the first compartment near the first opening. The protrusion prevents the foam material from filling the portion of the first compartment adjacent to the first opening in order to minimize leakage of liquid through the first opening.

Other objects, features, and advantages of the present invention will become apparent from the following detailed description. It should be understood, however, that the detailed description and specific examples, while indicating preferred embodiments of the invention, are given by way of illustration only and various modifications may naturally be performed without deviating from the gist of the present invention.

DETAILED DESCRIPTION OF PREFERRED EMBODIMENTS

Preferred embodiments of the present invention will be described in detail hereinbelow with reference to the attached drawings. The invention relates generally to cartridges for containing liquid, such as but not limited to ink, for ink jet printers, and methods of making and using the same. Ink jet printer cartridges are generally mounted in ink jet printers and supply liquid, such as ink, to ink jet print heads in the printers. Typically, an ink jet print head includes a reservoir for supplying ink to a plurality of ejection outlets. A print head carriage is used to move the print head horizontally across a printing medium and a platen is used to vertically advance the medium. As the print head is moved across a medium, ink is selectively ejected through the ejection outlets at proper timings according to well known ink jet printing methods to produce the desired output on the medium. As the ink is ejected, the ink cartridge supplies more ink to the print head's internal reservoir through an ink inlet port. Once the ink cartridge is depleted of ink, the ink cartridge is replaced with a filled cartridge or refilled. The ink jet printer may be a stand-alone unit that may be interfaced with a general purpose computer, but may alternatively be part of an integrated system such as a facsimile machine, copy machine, ticket printing machine, or the like.

Figure 1:
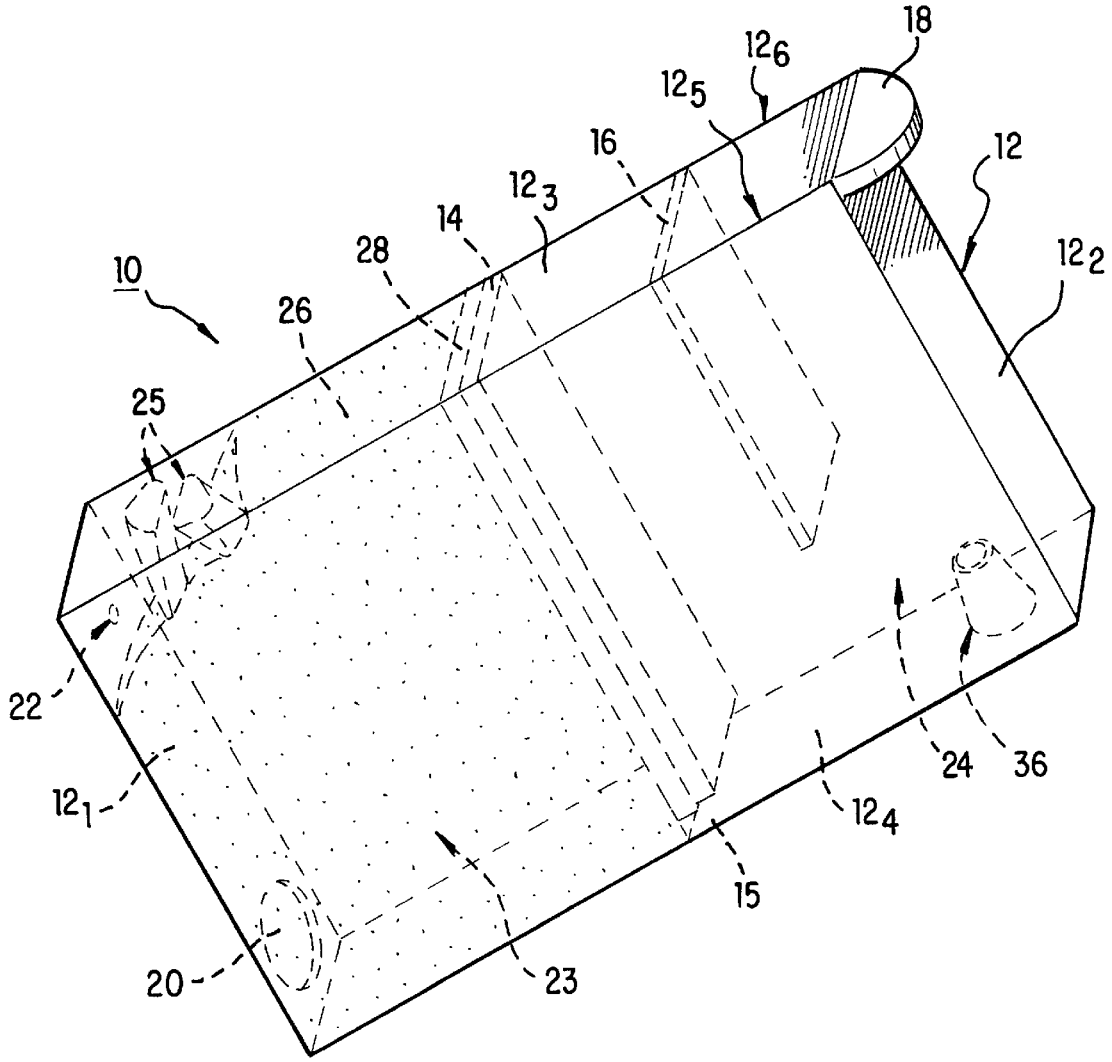
FIG. 1 is a perspective view of a cartridge according to an embodiment of the present invention.

FIG. 1 shows a perspective view of a cartridge according to an embodiment of the present invention. The ink cartridge 10 includes a container 12, a foam material 26, and a stranded material 28. The container 12 has a front wall $\mathbf{12}_1$, a rear wall $\mathbf{12}_2$, a top wall $\mathbf{12}_3$, a bottom wall $\mathbf{12}_4$, and two side walls $\mathbf{12}_5$ and $\mathbf{12}_6$. An inner partition wall 14 divides the container into first and second compartments 23 and 24. The first compartment 23 holds both the foam material 26 and the stranded material 28, and the second compartment 24 is filled with ink. For convenience, ink cartridges are described herein with reference to the orientation of the structures shown in the accompanying drawings, and terms relating to the structure orientation, such as front, rear, top, bottom, upper, and lower, are not intended to limit the invention or claims. For example, the front wall, rear wall, top wall, bottom wall, and two side walls could be referred to as a first wall, second wall, third wall, fourth wall, and fifth and sixth walls, respectively.

Figure 2:
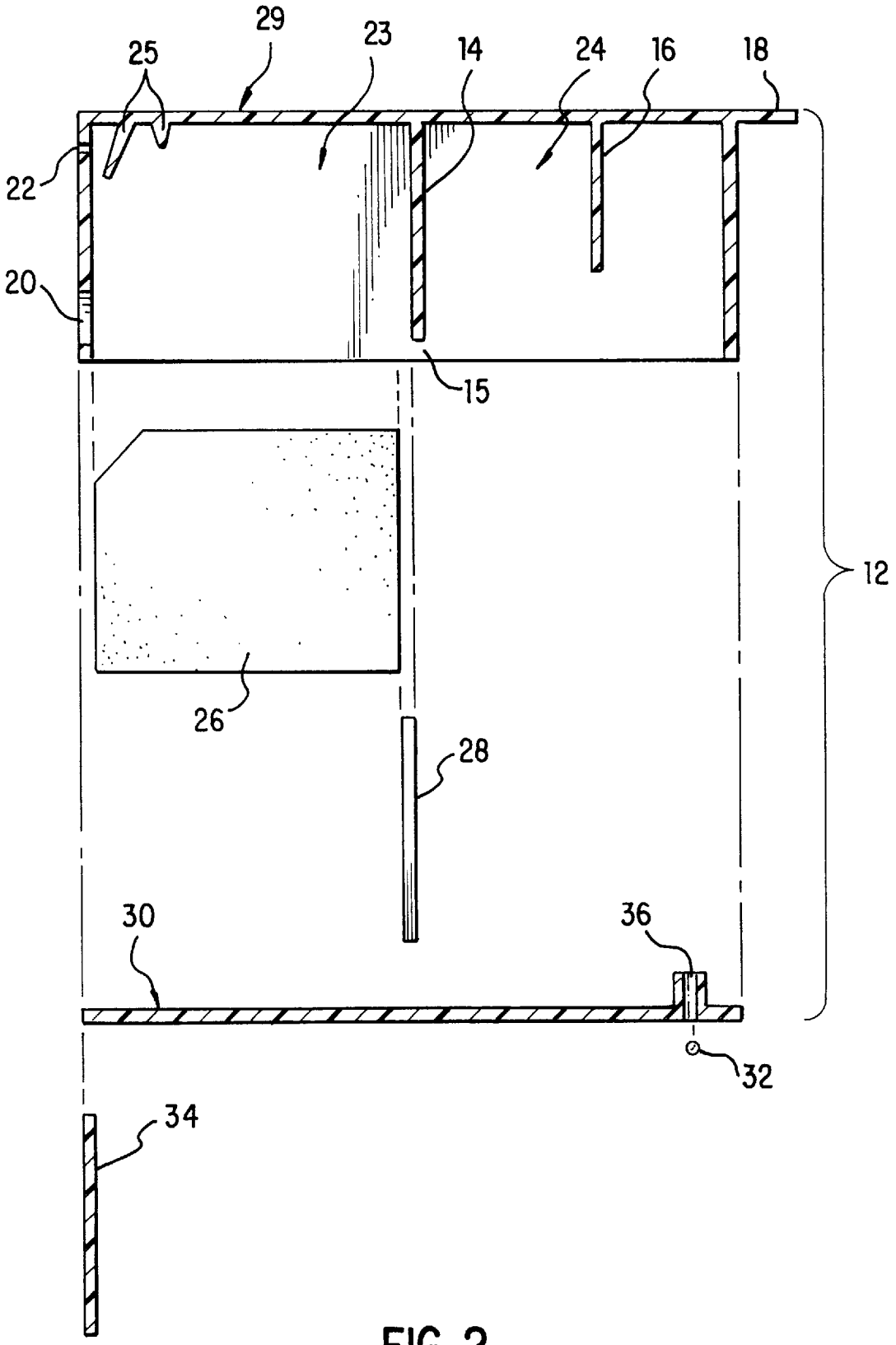
FIG. 2 is a cross-sectional exploded side view of the cartridge shown in FIG. 1.

FIG. 2 shows a cross-sectional exploded side view of the cartridge shown in FIG. 1. In a preferred embodiment, the container 12 is formed of semi-transparent plastic and in two separate sections to allow for simplifying molding of the container. The first section 29 includes the front wall $\mathbf{12}_1$, rear wall $\mathbf{12}_2$, top wall $\mathbf{12}_3$, and two side walls $\mathbf{12}_5$, and $\mathbf{12}_6$, while the second section 30 forms the bottom wall $\mathbf{12}_4$ of the container. The top wall $\mathbf{12}_3$ extends beyond the rear wall $\mathbf{12}_2$ to provide a tab 18. Additionally, the first section of the container includes the inner partition 14 that extends between the side walls beginning at the top of the side walls $\mathbf{12}_5$ and $\mathbf{12}_6$ ending near, but spaced from, the bottom of the side walls. Because the partition does not extend to the bottom of the side walls $\mathbf{12}_5$ and $\mathbf{12}_6$, and thus does not extend to the bottom wall $\mathbf{12}_4$, a gap 15 remains between the bottom of the partition and the bottom wall $\mathbf{12}_4$, to allow communication between the two compartments 23 and 24 of the container.

Figure 3:
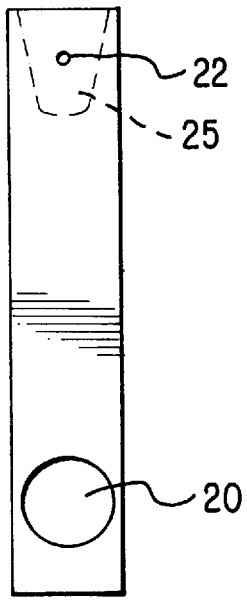
FIG. 3 is a front view of the cartridge shown in FIG. 1.
Figure 4:
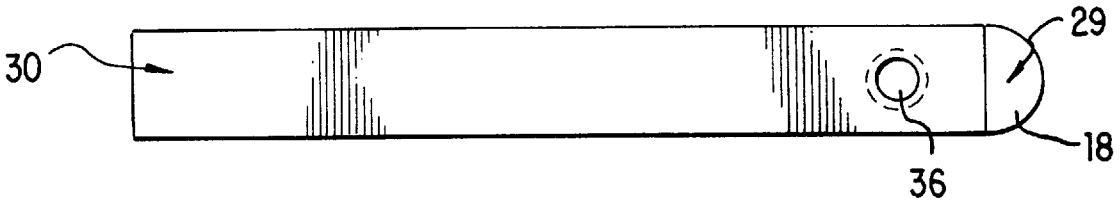
FIG. 4 is a bottom view of the cartridge shown in FIG. 1.

The second compartment 24 of the container has a slosh guard, which is formed as a wall 16 parallel to the partition wall 14. The slosh guard wall 16 extends between the side walls $\mathbf{12}_5$ and $\mathbf{12}_6$ beginning at the top wall. As shown in FIG. 2, the slosh guard wall 16 is shorter than the partition 14. The upper portion of the first compartment 23 is provided with a protrusion 25 that is located towards the front wall. As shown in FIGS. 2 and 3, a first circular opening 22 and a lower second circular opening 20 are provided in the front wall. The standard material 28 and the foam material 26 are disposed within the first compartment 23 of the container. As shown in FIGS. 2 and 4, the bottom wall is provided with a filling port 36. The filling port 36 is located under the second compartment 24 to allow the second compartment to be filled with liquid after the two sections 29 and 30 of the container are joined together.

A metal or plastic ball 32 is disposed within the filling port 36 after filling, to seal the port and prevent leakage. In further embodiments, other suitable means, including, but not limited to, a plug or cap, is used to seal the filling port. Additionally, a seal 34 is temporarily attached to the front wall to seal the first and second openings in the front wall and make the container airtight. Before use, the seal 34 is removed from the container to expose the first and second openings. In a preferred embodiment, the seal 34 is made of a thin layer of plastic that is partially "welded" to the front wall through the use of ultrasound. The thin layer of plastic extends past an edge of the front wall (preferably an edge between the front wall and one of the side walls) so that it can be easily gripped and pulled to break the partial weld for removal. In further embodiments, other sealing means for sealing the first and second openings may be used, including, but not limited to, plastic film, tape, caps, plugs or other similar material.

Figure 5:
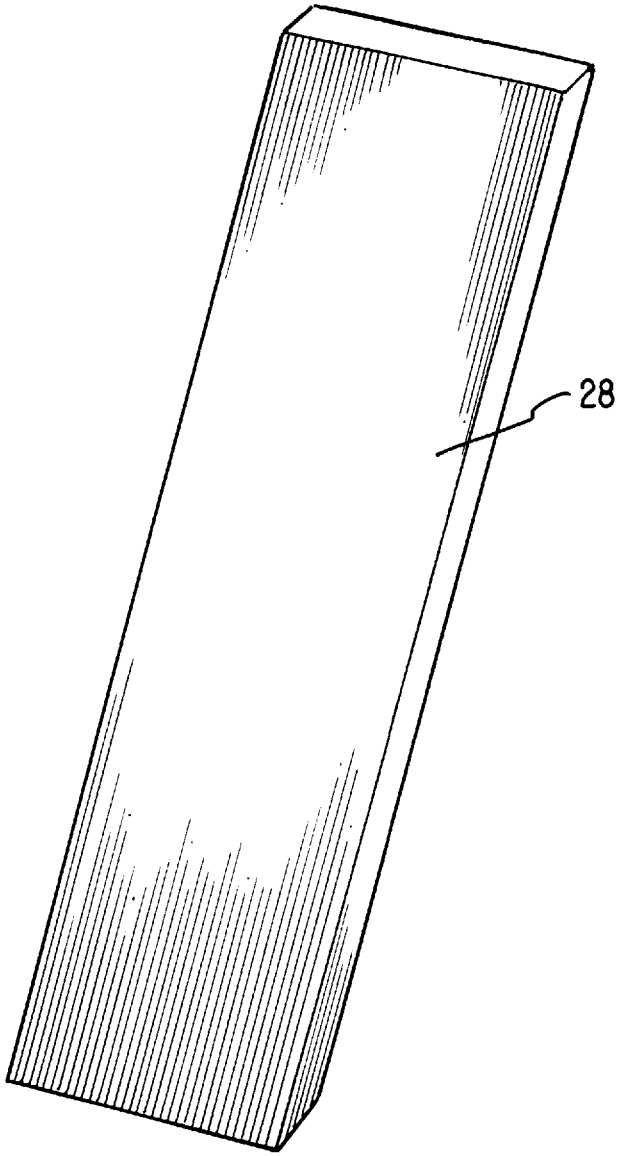
FIG. 5 is a perspective view of stranded material used in a cartridge according to an embodiment of the present invention.

FIG. 5 shows stranded material used in an ink cartridge according to an embodiment of the present invention. The stranded material 28 is formed by long, thin strands of fiber, preferably that extend in parallel to one another from top to bottom. The strands are, preferably, not woven together but are merely laid alongside one another, and heat or other suitable means is used to fuse the fibers. The resulting material contains numerous vertical capillary channels due to the orientation of the strands. The stranded material used in one embodiment of the present invention is similar to the material commonly used for making cigarette filters and is commonly referred to as formed and bonded polyolefin fiber, which is available from American Filtrona Company. In a preferred embodiment of the present invention, the stranded material 28 is formed with a rectangular cube shape and is inserted into the first compartment 23 so as to extend along the partition 14 beginning at the top wall and ending adjacent to the communication gap 15 (i.e., a location between the end of the partition and the bottom wall). Preferably, a gap is provided between the bottom end of the stranded material 28 and the bottom wall to allow direct communication between liquid from the second compartment and the foam material 26. However, in further embodiments, the stranded material may extend all the way from the top wall to the bottom wall, or the stranded material may start at some point below the top wall and extend with or without a gap to the bottom wall, thus allowing further control of initial back pressure or vacuum in the second chamber.

Figure 6:
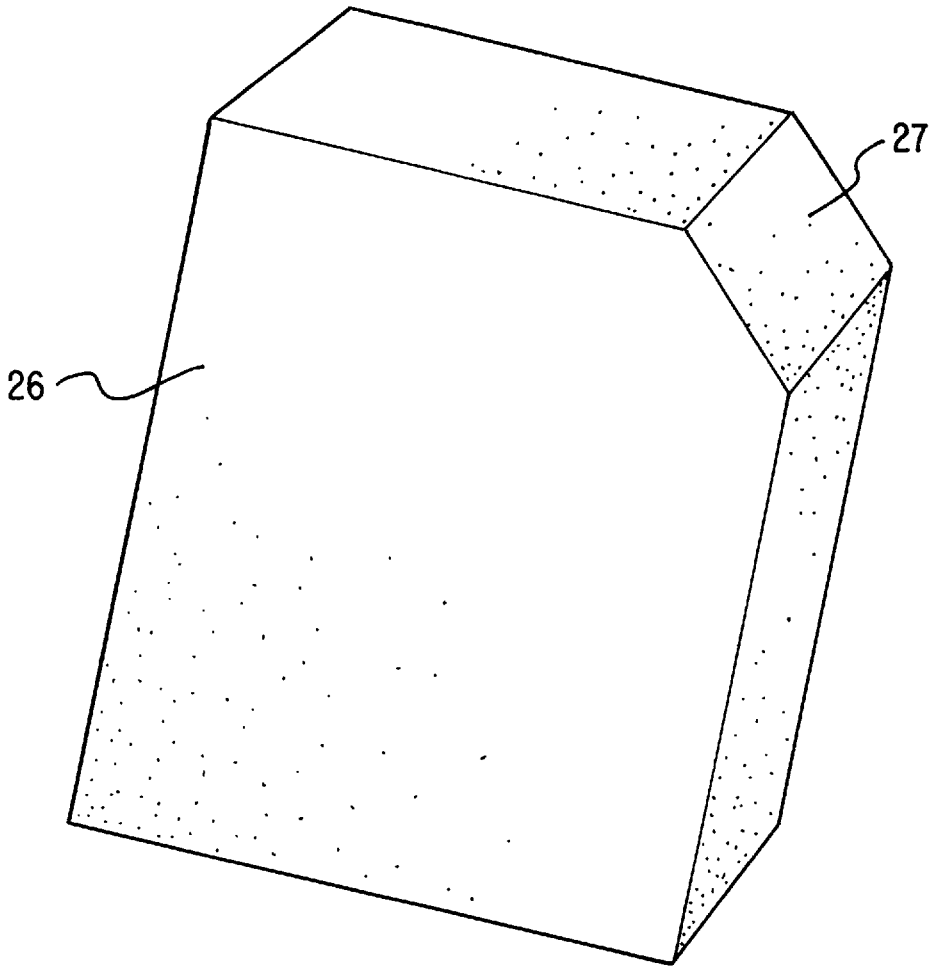
FIG. 6 is a perspective view of foam material used in a cartridge according to an embodiment of the present invention.

FIG. 6 shows foam material used in an embodiment of the present invention. The foam material 26 used in the illustrated embodiment is a standard foam or porous material with a constant or varying pore size. The foam material 26 is inserted into the first compartment to fill the first compartment from the stranded material 26 to the front wall and from the top wall to the bottom wall, except in the area near the protrusion 25. The foam material is formed in a rectangular cube shape with the upper front corner 27 removed. In other embodiments, the foam material is provided with other suitable shapes.

Figure 7:
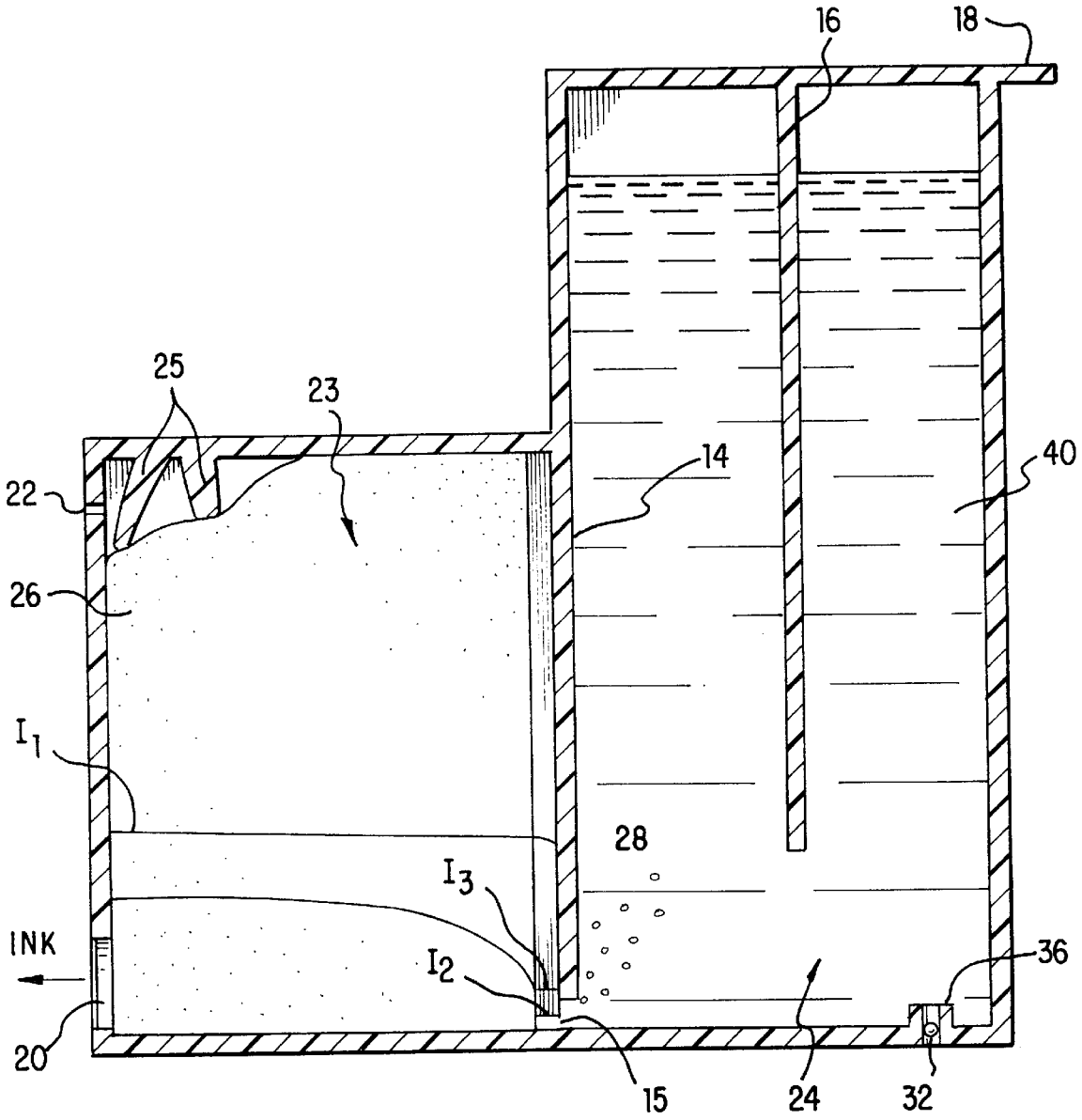
FIG. 7 is a cross-sectional view of a cartridge according to another embodiment of the present invention.

FIG. 7 shows a cross-sectional view of an ink cartridge according to another embodiment of the present invention. In this embodiment, the second compartment 24 is larger than the first compartment 23, to increase the amount of liquid that may be stored.

Figure 10:
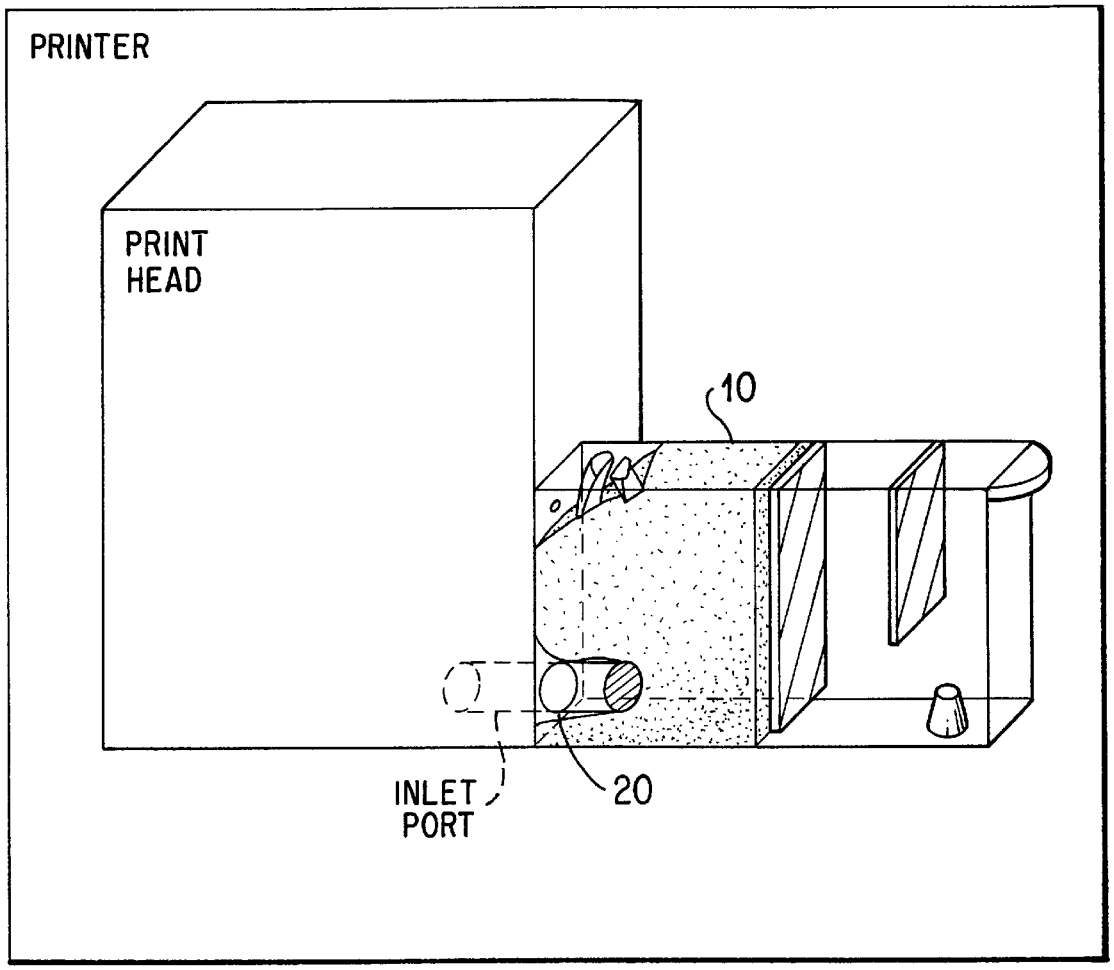
FIG. 10 shows one embodiment of the present invention in which the ink inlet port of a print head is inserted into the cartridge shown in FIG. 1.

The operation of the ink cartridge of the illustrated embodiment of the present invention will now be explained with reference to FIG. 7. As explained above, the second compartment 24 of the ink cartridge 10 is filled with ink 40 through the filling port 36. A communication gap 15 between the partition 14 and the bottom wall allows ink to reach the foam material 26 and stranded material 28 in the first compartment 23. Through capillary action, both the foam material and the stranded material draw ink up to a certain level $I_1$. The ink level $I_1$ in the first compartment depends on factors such as the viscosity of the ink and the densities of the foam and stranded materials. Subsequently, the ink cartridge 10 is mounted in an ink jet printer for supplying ink to the ink jet print head. An ink inlet port of the print head is interfaced with or inserted into the second opening 20 of the ink cartridge, as shown in FIG. 10. In this way, the second opening functions as an ink outlet through which ink from the ink cartridge is supplied to the print head.

As the print head ejects ink onto the recording medium, a suction effect is created in the ink inlet port. The suction causes the ink in the foam material 26 to be transferred to the print head through the ink inlet port. As ink is removed, ink from the stranded material 28 and ink 40 from the second compartment replaces the ink drawn out of the foam material through capillary action. Similarly, ink drawn out of the stranded material is replaced by ink 40 from the second compartment through capillary action. As ink is drawn out of the cartridge, a vacuum develops in the sealed second compartment. On the other hand, outside air can enter the first compartment through the small "air inlet" 22 (i.e., first opening) located above the ink outlet 20. Thus, a pressure difference develops between the two compartments.

Eventually, the pressure difference becomes so high that the ink 40 in the second compartment ceases to replace the ink flowing out of the first compartment. At this point, the ink in the stranded material 28 is transferred to the foam material 26, but is not replaced by ink 40 from the second compartment. Instead, the ink is replaced by air drawn in through the air inlet. As this continues, the ink level in the stranded material 28 falls to a level $I_2$ below the bottom of the partition 14 so that air is introduced through the communication gap 15 into the second compartment. When the air bubbles into the second compartment, the vacuum is slightly relieved to lower the pressure difference between the two compartments. This allows ink 40 from the second compartment to flow into the stranded material 28 so that the ink level in the stranded material rises to a level $I_3$ above the bottom of the partition 14.

As ink continues to be drawn out of the foam material 26, the level of ink in the stranded material 28 bounces between levels $I_2$ and $I_3$. In other words, the internal pressure of the ink cartridge is substantially kept at a constant value due to the capillary force of the stranded material 28. In this way, a sufficient flow of ink 40 from the second compartment (through the foam material 26) to the print head can be maintained until the ink level in the second compartment falls below the level of the partition 14. Soon thereafter, the second compartment of the ink cartridge 10 must be refilled with ink or a new ink cartridge must be substituted.

The provision of the stranded material along the partition creates many vertical capillary channels in the first compartment. While these channels initially fill with ink just like the pores of the foam material, the stranded material is easier to pull air through than the foam material. This is because the structure of the stranded material and orientation of the strands act to provide long channels that extend uninterrupted for the length of the material. In contrast, the foam material is formed with a cell type structure. Thus, air attempting to reach the bottom of the partition through the foam material meets with resistance the entire way down. On the other hand, the stranded material provides numerous low resistance air paths that bring air closer to the communication gap as the pressure difference between the two compartments increases. Thus, the stranded material is superior to a foam-type material in delivering air to the second compartment in order to relieve the vacuum. The provision of the stranded material adjacent to the communication gap allows the internal pressure of the ink cartridge and the ink level in the foam material to be kept more constant. This, in turn allows ink to be supplied from the cartridge to the print head without interruption or the introduction of air bubbles.

Other features of the illustrated embodiments will now be explained with reference to FIGS. 1 and 2. As previously explained, the upper portion of the first compartment 23 is provided with a protrusion 25 to minimize "sputtering." In a preferred embodiment, the protrusion consists of two projections that extend from the top wall, with the front projection being longer and extending below the level of the air inlet 22. As shown in FIG. 7, the protrusion 25 prevents the foam material 26 from filling a portion of the first compartment along the front wall 12, and near the air inlet 22. When air in the ink cartridge expands due to a temperature increase, air is released from the foam material and out the air inlet with minimized risk of ink "spitting" or "sputtering" out the air inlet. Besides preventing the foam material 26 from occupying the area adjacent to the air inlet, the protrusion 25 acts as a baffle to deflect ink that is "spit" from the foam material towards the air inlet. While using a foam material that has the upper front corner 27 removed is advantageous, the protrusion 25 minimizes sputtering even if the foam material has a rectangular shape.

As discussed above, the container 12 includes a slosh guard wall 16. As the level of ink in the second compartment 24 lowers, the movement of the ink cartridge 10 by the print head carriage tends to cause the remaining ink 40 to "slosh" around in the second compartment. The slosh guard wall 16 lessens the amount of sloshing by limiting the movement of the ink within the second compartment. For example, if movement causes the ink to slosh up the rear wall and across the top wall towards the partition 14, the slosh guard wall blocks the path of the ink to cause it to return after traversing only halfway across the top wall of the second compartment 24. Without the slosh guard wall, the ink would slosh across the top wall through the entire depth of the second compartment. The slosh guard wall 16 reduces sloshing so that noise and the amount of ink foaming are reduced. Further, a tab 18 is formed where the top wall extends beyond the rear wall. The tab acts as a handle to make it easier to lock the ink cartridge into its holder and to lift the ink cartridge out of the holder.

A preferred method of manufacturing the cartridge of the illustrated embodiment of the present invention will now be explained with reference to FIG. 2. As explained above, the container 12 is formed as two separate plastic sections 29 and 30 to allow for easier molding. The stranded material 28 and the foam material 26 are inserted into the first compartment 23 of the container. After the two materials 26 and 28 are inserted, the two sections 29 and 30 of the container are welded together with ultrasound. Then, the second compartment 24 is filled with liquid through the filling port 36, which is located under the second compartment. After filling, a metal or plastic ball 32 is inserted into the filling port 36 to seal the port. Finally, as explained above, a plastic seal 34 is partially welded to the front wall with ultrasound to seal the first and second openings 22 and 20 and make the container airtight. Before use, the plastic seal 34 is removed from the container to expose the first and second openings.

Figure 8:
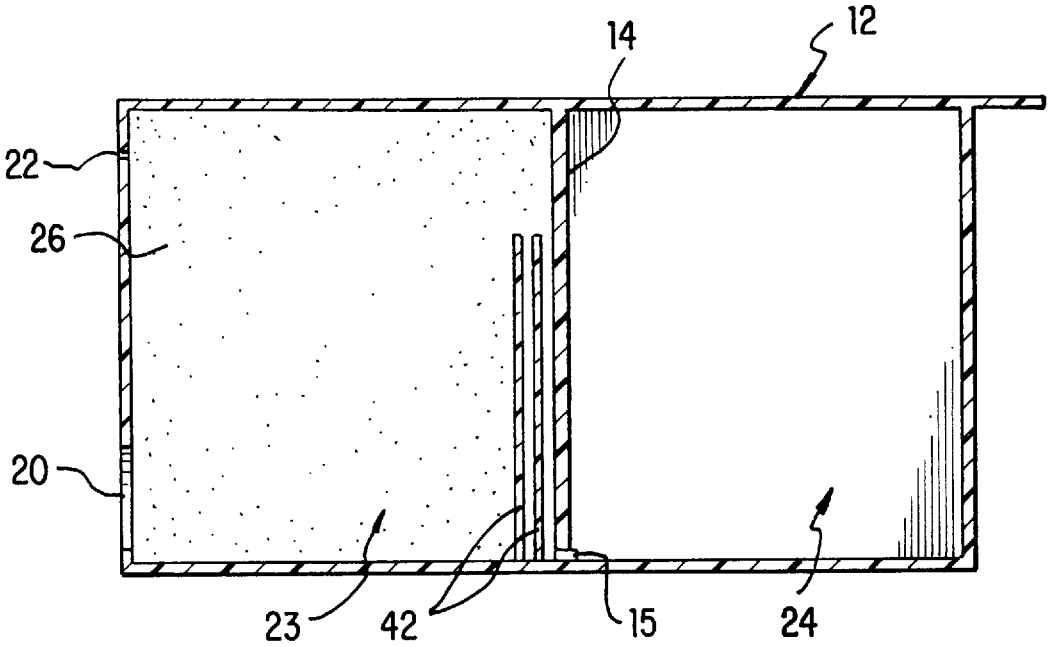
FIG. 8 is a cross-sectional view of a cartridge according to yet another embodiment of the present invention.

FIG. 8 shows a cross-sectional view of an ink cartridge according to another embodiment of the present invention. In this embodiment, one or more ribs 42 are provided on one or both side walls $\mathbf{12}_5$ and $\mathbf{12}_6$ of the container. Although the first compartment 23 contains only the foam material 26, (i.e., the stranded material may be omitted in this embodiment) the ribs 42 create a space adjacent to the side wall that is not filled by the foam material. The space forms a low resistance air path for air entering through the air inlet 22 to reach to the communication gap 15, and thus the second compartment 24. In yet a further embodiment, the combination of side wall ribs 42 and stranded material form a yet lower resistance air path.

Figure 9:
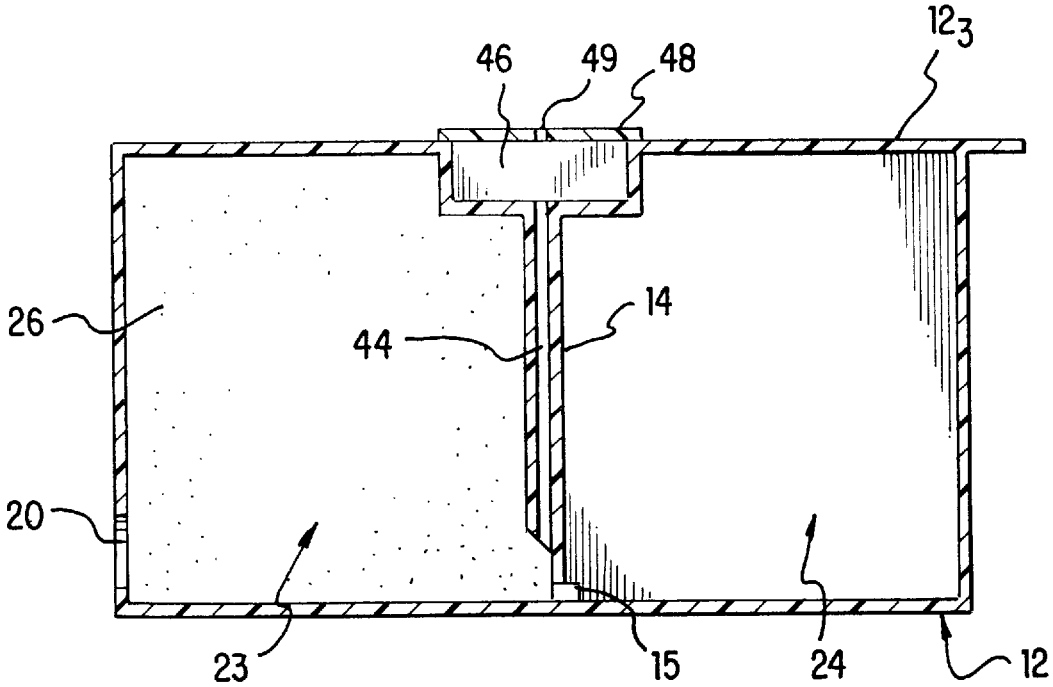
FIG. 9 is a cross-sectional view of a cartridge according to still another embodiment of the present invention.

FIG. 9 shows a cross-sectional view of an ink cartridge according to still another embodiment of the present invention. In this embodiment, the partition wall 14 is provided with a hollow interior forming a bleed hole 44 therethrough. The bleed hole 44 extends from the bottom of the partition wall through the top wall $\mathbf{12}_3$. Additionally, a recessed area may be provided in the top wall adjacent to the partition wall 14 to allow a foam or stranded material 46 to be placed over the top of the bleed hole 44 to control air flow and minimize leakage. When the material 46 is provided, the recess is covered by a seal or cap 48 having an air opening 49. While in this embodiment the first compartment 23 preferably contains only the foam material 26, the bleed hole 44 creates a low resistance air path to the communication gap 15. In other words, air can enter through the opening 49, pass through the material 46 and the bleed hole 44, and enter the second compartment 24 through the communication gap 15. The material 46 restricts air flow to a certain degree so that the vacuum in the second compartment is regulated. Additionally, the material covers outer opening 49 to minimize ink leakage from the cartridge.

As discussed above, preferred embodiments of the present invention provide a cartridge with a novel type of air introduction passage for regulating the internal pressure of the cartridge. Specifically, a stranded material is disposed in the first compartment in the vicinity of the communication gap in order to regulate the internal pressure of the cartridge by selectively providing a low resistance path for air to pass from the first compartment, through the stranded material and the gap, and into the second compartment. The provision of the stranded material in the cartridge of the present invention allows the cartridge to supply ink to a print head while keeping the pressure in the cartridge, and thus the vacuum in the print head, substantially constant.

Embodiments of the present invention described above relate to using the ink cartridge with a moving ink jet print head. However, the ink cartridge could also be used with stationary head printers, such as line-type print heads that remain stationary because its width is equal to the maximum line width. The disclosed embodiments could also be easily adapted by one of ordinary skill in the art to work with a color print head that requires more than one supply of ink. Similarly, other design choices, such as the length of the slosh guard and the exact shape and size of the tab could easily be adapted. Likewise, the location and shape of the protrusion could be changed and the location and size of the openings in the first compartment could be altered. Additionally, embodiments of the present invention may not include all of the features described above. For example, features such as a slosh guard, a protrusion, or a tab may not be present in all embodiments. Furthermore, while the above description refers to the term "ink" in connection with the print head, cartridge, and liquid stored in the cartridge, it will be understood that embodiments of the invention may employ liquids other than inks, including but not limited to head cleaning solutions, adhesives, liquid coatings, lubricants, or the like.

While there has been illustrated and described what are presently considered to be the preferred embodiments of the present invention, it will be understood by those skilled in the art that various other modifications may be made, and equivalents may be substituted, without departing from the true scope of the invention. Additionally, many modifications may be made to adapt a particular situation to the teachings of the present invention without departing from the central inventive concept described herein. Therefore, it is intended that the present invention not be limited to the particular embodiments disclosed, but that the invention include all embodiments falling within the scope of the appended claims.

What is claimed is:

1. A cartridge for use with a printer having a print head with an inlet port for receiving liquid from the cartridge, said cartridge comprising:

a container having an interior for holding a liquid;

a partitioning wall dispose at least in the interior, the paritioning wall substantially dividing the container into a first compartment and a second compartment but leaving a gap between the first compartment and the second compartment for allowing communication between the first compartment and the second compartment;

an air inlet located on the container in communication with the first compartment, for allowing air to enter the first compartment;

an outlet located on the container in communication with the first compartment, for interfacing with the print head to allow the first compartment of the container to supply liquid to the inlet port of the print head;

a stranded material disposed in the first compartment and extending along the partitioning wall to a location adjacent to the gap, the stranded material comprising a plurality of parallel strands; and a foam material disposed in the first compartment and extending at least from the stranded material to the outlet;

wherein the stranded material defines a plurality of flow paths along the parallel strands and substantially parallel to the partitioning wall, to regulate an internal pressure of the cartridge by selectively providing a low resistance path for air to pass from the first compartment, through the stranded material and the gap, and into the second compartment.

2. The cartridge as defined in claim 1, further comprising another partitioning wall in a form of an inner wall located within the second compartment for decreasing sloshing of liquid in the second compartment.

3. The cartridge as defined in claim 1, further comprising a filling port located on the container in communication with the second compartment, for allowing liquid to enter the second compartment.

4. The cartridge as defined in claim 1, wherein the stranded material extends across a portion of the gap, but not an entirety of the gap, to allow the liquid in the second compartment to communicate directly with the foam material.

5. The cartridge as defined in claim 1, wherein the foam material abuts the stranded material and wherein the foam material and the stranded material fill substantially all of the first compartment except a portion of the first compartment adjacent to the air inlet.

6. The cartridge as defined in claim 1, further comprising at least one protrusion located in the first compartment adjacent to the air inlet, for preventing the foam material from filling a portion of the first compartment adjacent to the air inlet and for minimizing leakage of the liquid from inside the first compartment, through the air inlet.

7. The cartridge as defined in claim 1, wherein the container is formed by two separate pieces that are joined together after the foam material and the stranded material are inserted in one of the pieces.

8. The cartridge as defined in claim 1, wherein the foam material is shaped as a rectangular cube with a corner nearest the air inlet removed so that the foam material does not fill a portion of the first compartment adjacent to the air inlet.

9. The cartridge as defined in claim 1, wherein a seal is temporarily attached to the container so as to cover the air inlet and the outlet in order to seal the air inlet and the outlet.

10. A method of supplying liquid to a printer using a cartridge, the printer having a print head with an inlet port for receiving the liquid, the cartridge having:

a container;

a partitioning wall disposed at least in the container, the partitioning wall substantially dividing the container into a first compartment and a second compartment but leaving a gap to allow communication between the first compartment and the second compartment;

a first opening on the container in communication with the first compartment;

a second opening on the container in communication with the first compartment;

a stranded material located in the first compartment so as to extend along the partitioning wall to a location adjacent to the gap, the stranded material comprising a plurality of parallel strands along which are defined a plurality of flow paths; and a foam material located in the first compartment and extending from the stranded material to an opposite edge of the first compartment, the foam material substantially filling the first compartment, wherein the second compartment contains the liquid and the liquid passes through the gap to the first compartment;

said method comprising the steps of:

interfacing the cartridge with the inlet port of the print head such that the inlet port interfaces with the foam material at a location proximate to the second opening;

drawing liquid from the foam material through the inlet port and to the print head;

drawing air into the first compartment through the first opening; and selectively providing a low resistance path through the flow paths of the stranded material for air to pass through, so that air is drawn from the first compartment, through the stranded material and the gap, and into the second compartment.

* * * * *